US007258582B2

(12) United States Patent
Maglica

(10) Patent No.: US 7,258,582 B2
(45) Date of Patent: Aug. 21, 2007

(54) TAIL CAP ASSEMBLY

(75) Inventor: Anthony Maglica, Anaheim, CA (US)

(73) Assignee: Mag Instrument, Inc., Ontario, CA (US)

( * ) Notice: Subject to any disclaimer, the term of this patent is extended or adjusted under 35 U.S.C. 154(b) by 102 days.

(21) Appl. No.: 11/269,283

(22) Filed: Nov. 7, 2005

(65) Prior Publication Data

US 2006/0056173 A1 Mar. 16, 2006

Related U.S. Application Data

(60) Continuation of application No. 10/785,852, filed on Feb. 23, 2004, now Pat. No. 6,991,360, which is a division of application No. 09/932,443, filed on Aug. 16, 2001, now Pat. No. 6,722,772.

(51) Int. Cl.
*H01R 13/24* (2006.01)

(52) U.S. Cl. ..... 439/700; 439/824; 439/289; 439/500; 362/202

(58) Field of Classification Search ..... 439/700, 439/824, 289, 500; 362/202
See application file for complete search history.

(56) References Cited

U.S. PATENT DOCUMENTS 4,656,565 A 4/1987 Maglica
4,916,588 A * 4/1990 Chu ..... 362/203
5,158,358 A 10/1992 Maglica
5,349,506 A * 9/1994 Maglica ..... 362/158
5,560,705 A 10/1996 Shiau
5,678,921 A * 10/1997 Kish et al. ..... 362/205
6,474,834 B2 * 11/2002 Lai ..... 362/206

FOREIGN PATENT DOCUMENTS

JP A-10-069801 3/1998

* cited by examiner

*Primary Examiner*—Tho D. Ta
(74) *Attorney, Agent, or Firm*—Jones Day

(57) ABSTRACT

An improved tail cap assembly having features that allow direct electrical contact between a battery and the barrel of a flashlight is provided. The tail cap assembly includes a cap and a conductive spring. The cap is adapted to engage with the flashlight barrel. The tail cap assembly includes a cap which has a seat, two ears extending from the seat and gaps between the two ears. A conductive spring that includes a base portion is disposed between the ears. At least a part of the base portion is arranged to bear against the seat. And the base portion extends outward in a radial direction through at least one of the gaps. The conductive spring may be a coil spring, and the base portion is oval or asymmetrical shaped.

20 Claims, 6 Drawing Sheets

TAIL CAP ASSEMBLY

This is a continuation of a application Ser. No. 10/785,852, filed Feb. 23, 2004, which issued as U.S. Pat. No. 6,991,360 on Jan. 31, 2006, which is a divisional of Ser. No. 9/932,443, filed Aug. 16, 2001, which issued as U.S. Pat. No. 6,722,772 on Apr. 20, 2004.

BACKGROUND OF THE INVENTION

1. Field of the Invention

The field of the present invention relates to flashlights and flashlight components.

2. Background

Various flashlight designs are known in the art. Flashlights typically include one or more dry cell batteries. In certain designs, the batteries are arranged in series in a battery compartment of a barrel or tube that acts as a handle for the flashlight. An electrical circuit is frequently established from one electrode of the battery or batteries through a conductor to a switch, then through a conductor to one electrode of the lamp bulb. After passing through the filament of the lamp bulb, the electric circuit emerges through a second electrode of the lamp bulb in electrical contact with a conductor, which in turn is in electrical contact with the other electrode of the battery or batteries. Actuation of the switch to complete the electric circuit enables electricity to pass through the filament, thereby generating light which is typically focused by a reflector to form a beam of light.

The production of light from such flashlights has often been degraded by the quality of the reflector used and the optical characteristics of any lens interposed in the beam path. As a result, efforts at improving such flashlights have often attempted to address the quality of their optical characteristics. For example, more highly reflective, well-defined reflectors have been found to provide a better-defined focus thereby enhancing the quality of the light beam produced. Additionally, several advances have been achieved in the light emitting characteristics of flashlight lamp bulbs.

Despite such efforts, light beams produced by known flashlights are frequently elliptical or elongated in shape. These aberrations generally result from the fact that the flashlight lamp bulb is not properly aligned with the principal axis of the reflector of the assembled flashlight.

In various flashlight designs, the lamp is supported within the flashlight by a holder or spacer within the barrel and extends into the flashlight reflector. Due to manufacturing and assembly operations and tolerances, however, after manufacture of the flashlight is fully completed, the lamp may be permanently misaligned with the reflector, resulting in degraded performance. Furthermore, simply locating the center of the lamp bulb on the principal axis of the reflector does not ensure that aberrations in the projected light beam will be eliminated. This is because the critical component of the lamp that must be centered relative to the reflector is the lamp filament.

One attempt at addressing the misalignment problem is described in U.S. Pat. No. 5,260,858, by A. Maglica. This patent describes a flashlight that includes a switch housing that partially floats within the barrel of the flashlight to allow for slight movement of the lamp relative to the reflector, thereby helping to ensure that the lamp and the lamp filament are centered relative to the reflector. However, in the centering mechanism described in U.S. Pat. No. 5,260,858, to the extent that the lamp filament is not centered within the bulb, then the lamp filament will not be properly centered within the reflector and optimal performance of the flashlight will not be achieved.

Switch designs that are adapted to close an electrical path between the lamp bulb and battery, or batteries, in response to axial movement of the head along the barrel and to open the electrical path in response to axial movement in the opposite direction along the barrel are known. While such switches have generally worked well for flashlights that employ smaller batteries of the AA or AAA type, known designs are not well suited for flashlights that employ larger battery sizes, such as C or D size batteries. One reason such designs are not well suited for flashlights employing larger batteries is that the positive electrode of the battery closest to the head end of the flashlight is urged against a conductor mounted flush against the bottom of the switch. As a result, the battery or batteries may become damaged in the event that the flashlight is dropped. The problem also becomes more acute as the number of batteries connected in series increases due to the added weight, and hence momentum, of the batteries. Another reason such switch designs are not well suited for flashlights with larger batteries is that they are not designed to handle the heat associated with higher amperage lamp bulbs rated for use with such batteries.

Current switch designs that open and close in response to axial movement of the head assembly along the barrel are also not designed to ensure that the filament of each bulb will always be properly aligned with the principal axis of the reflector. As a result, optimal performance of such flashlights is not always achieved.

Misalignment problems are likely to be more pronounced in flashlights with higher capacity bulbs, because such bulbs tend to be longer, thus accentuating any misalignment between the bulb holding mechanism of the flashlight and the reflector as well as any misalignment of the bulb filament within the bulb itself.

The development of flashlights having a variable focus, which produces a beam of light having variable dispersion, has also been accomplished. In such flashlights, the head assembly is typically rotatably connected to the barrel of the flashlight at the end where the bulb is retained. In addition, the head assembly is adapted to be controllably translatable along the barrel such that the relative positional relationship between the reflector and lamp bulb may be varied, thereby varying the dispersion of the light beam emanating through the lens from the lamb bulb. While variable focus flashlights have also employed switches that are adapted to open and close in response to the axial movement of the head assembly, such flashlights have generally been limited to flashlights employing AA and AAA batteries for a variety of reasons, including some of those described above.

In metal flashlights, the flashlight's tail cap is typically a component of the electrical circuit and there must be electrical continuity from one part of the tail cap to another, usually from an outer peripheral region to an inner peripheral region. In such designs when the tail cap and the barrel are anodized, painted, or otherwise treated so that the surface of the tail cap or the barrel loses all or a part of its ability to conduct current, then extra processing steps are required to either remove the non-conducting coating from electrical contact points or mask the contact points prior to forming the coating.

In order to avoid having to remove the nonconductive coating from the contact points of the tail cap, or mask the contact points, attempts have been made to eliminate the tail cap from the electrical circuit. Several different designs have been employed to achieve this end. Such designs, however, have required the use of a plurality of parts and multiple manufacturing steps. The elimination of any such parts and steps would decrease the overall manufacturing cost of the flashlight, as well as improve the reliability of the flashlight.

SUMMARY OF THE INVENTION

It is an object of the present invention to address or at least ameliorate one or more of the problems associated with the prior art noted above.

Accordingly, in a first aspect of the present invention, it is an object to provide a device that may be used to align the filament of a lamp bulb with a reflector, particularly flashlight reflectors, although the invention is not limited to flashlight reflectors.

In accordance with this object, in a first aspect of the present invention a combination for use in aligning a flashlight lamp bulb with the principle axis of a flashlight reflector is provided. The combination includes a lamp bulb and a lamp base. The lamp bulb has a pair of electrodes and a filament extending between the electrodes. The lamp base is adapted to receive the electrodes of the lamp bulb. The lamp bulb is secured to the base so that the electrodes extend through the base, the lamp bulb is disposed adjacent the base, and the filament of the lamp bulb is aligned with a predetermined axis extending through the base. The base is configured to be seated in a bore provided in a base receiver mounted adjacent to a forward end of the flashlight so as to align the predetermined axis of the base with the principal axis of the reflector.

In accordance with the first aspect of the present invention, a combination for use in aligning the filament of a lamp bulb with the principle axis of a reflector is also provided. The combination comprises a bi-pin lamp bulb and a lamp base. The lamp bulb has a bulb portion, a pair of electrodes and a filament extending between the electrodes. The lamp base comprises a conical frustum having a circular base end, a circular truncated end parallel to and concentric with the base end, and a conical-shaped side wall interposed between the two. The lamp base further includes two holes extending through the base in a direction parallel to an axis extending through the center of the base end and truncated end and adapted to receive the electrodes of the lamp bulb. The lamp bulb is secured to the base so that the electrodes extend through the base, the bulb portion is disposed adjacent the base, and the filament of the lamp bulb is aligned with the axis.

In yet another embodiment of the first aspect of the invention, a combination is provided that comprises a lamp bulb, a lamp base, a reflector, and a lamp base receiver. The lamp bulb includes a pair of electrodes and a filament extending between the electrodes. The lamp bulb is secured to the lamp base so that the center of the filament is aligned with a predetermined axis of the lamp base. The lamp base is adapted to receive the lamp base receiver and align the predetermined axis of the lamp base with the principal axis of the reflector.

The lamp base may include a tapered surface concentric about the predetermined axis, and the tapered surface may be seated against a matching tapered surface provided in the lamp base receiver that is concentric about the principal axis of the reflector.

In another aspect of the invention, a method of manufacturing a lamp bulb and lamp base combination is provided. The method comprises the steps of first obtaining a lamp bulb having a bulb portion, a pair of electrodes extending from the bulb portion, and a filament extending between the electrodes within the bulb portion. The lamp bulb is then inserted into a lamp base adapted to receive the electrodes of the lamp bulb until the bulb portion of the lamp bulb is adjacent the base and the electrodes extend through the base. The lamp base is adapted to permit lateral movement of the bulb portion and electrodes with respect to a predetermined axis extending through the lamp base. The lamp bulb is then laterally adjusted with respect to the predetermined axis of the base until the filament of the lamp bulb is aligned with the predetermined axis. The lamp bulb is then secured to the lamp base to preserve the alignment of the filament with the predetermined axis.

In yet another aspect of the invention it is an object to provide a flashlight with improved optical characteristics. The flashlight includes a barrel for retaining one or more batteries. A head assembly is mounted to a first end of the barrel. The head assembly includes a lens and a reflector having a central opening surrounding the principal axis of the reflector. A lamp bulb having a filament extending between two electrodes is secured to a lamp base so that the lamp bulb is disposed adjacent the base and the filament of the lamp bulb is aligned with a predetermined axis extending through the base. A lamp base receiver is mounted adjacent the first end of the barrel. The lamp base is removably seated in a complementary bore extending through the lamp base receiver, and the lamp base receiver is mounted adjacent the first end of the barrel so that the lamp bulb extends through the central opening in the reflector and the predetermined axis of the lamp base is aligned with the principal axis of the reflector. A tail cap is attached to the second end of the barrel. An electrical circuit couples the electrodes of the lamp bulb to the one or more batteries. A switch is interposed in the electrical circuit for turning the flashlight on and off.

In still another aspect of the invention, it is an object to provide a new tail cap assembly for a flashlight having a barrel with a forward end and a rearward end. The tail cap assembly comprises a tail cap comprising a first body portion having a first end and a second end and being adapted to removably engage the interior of the flashlight barrel at the rearward end. A second body portion is attached to the second end of the first body portion and is adapted to enclose the rearward end of the flashlight barrel when the first body portion engages the barrel. A spring seat is provided at the first end of the first body portion, and may comprise a pair of spaced apart, opposing ears, with opposing gaps provided at the ends of the opposing ears. The tail cap assembly further includes a conductive spring that includes a base portion removably retained between the opposing ears of the spring seat. The base portion is adapted to extend outward in a radial direction through the opposing gaps provided between the ears so as to make physical contact with the inner surface of the barrel when the tail cap is engaged with the barrel.

In still another aspect of the invention, it is an object of the invention to provide a new design for a flashlight that does not require the tail cap to be included in the electrical circuit. The flashlight includes a barrel for retaining a battery source of power and having first and second ends. The barrel further comprises an electrically conductive material. A bulb is positioned at the first end of the barrel. A tail cap is removably engaged with the interior of the second end of the barrel. The tail cap includes a spring seat positioned on the interior of the barrel. The spring seat comprises a pair of opposing ears spaced apart from the axis of the barrel. A conductive spring is disposed between the tail cap and a case electrode of the battery source of power. The conductive spring includes a base portion removably retained between the opposing ears of the spring seat and which is adapted to extend outward in a radial direction through opposing gaps provided between the ears so as to make physical contact with the inner surface of the barrel when the tail cap is engaged with the barrel. In addition, the spring serves to provide a direct electrical path between the case electrode of the battery source of power and the barrel. The flashlight further comprises an electrical circuit coupling the bulb to the battery source of power that includes the direct electrical path provided by the spring between the case electrode and barrel. A switch is interposed in the electrical circuit to turn the flashlight on and off.

The above and other objects, features and advantages of the present invention will become apparent from the following detailed description of the preferred embodiments.

DETAILED DESCRIPTION OF THE PREFERRED EMBODIMENTS

Figures 1, 2:
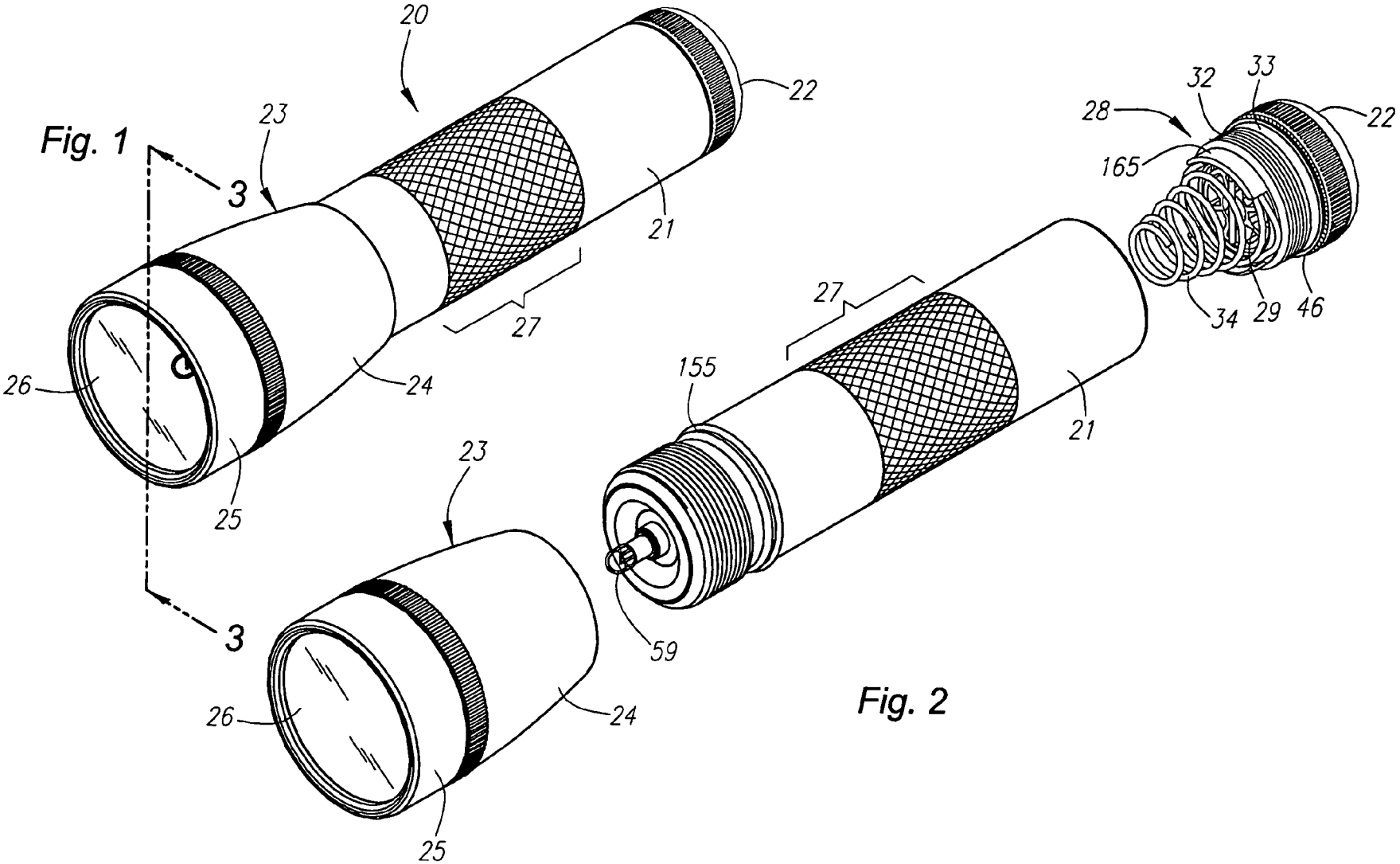
FIG. 1 is a perspective view of a flashlight in accordance with the present invention.
FIG. 2 is an exploded perspective view of the flashlight of FIG. 1 where the tail cap assembly and head assembly both have been disengaged from the barrel.

Referring first to FIG. 1, a flashlight in accordance with a preferred embodiment of the present invention is illustrated in perspective, generally at 20. The flashlight illustrated in FIG. 1 incorporates a number of distinct aspects of the present invention. These distinct aspects have all been incorporated into the flashlight 20 that is described in detail below and illustrated in the accompanying figures for the purpose of illustrating a preferred embodiment of the invention it is to be expressly understood, however, that the present invention is not restricted to flashlights that incorporate all of the distinct aspects of the present invention described herein. Rather, the present invention includes flashlights that incorporate one or more of the separate aspects of the invention. It is also to be understood that the present invention is also directed to each of the separate aspects of the flashlight described below.

Figure 3:
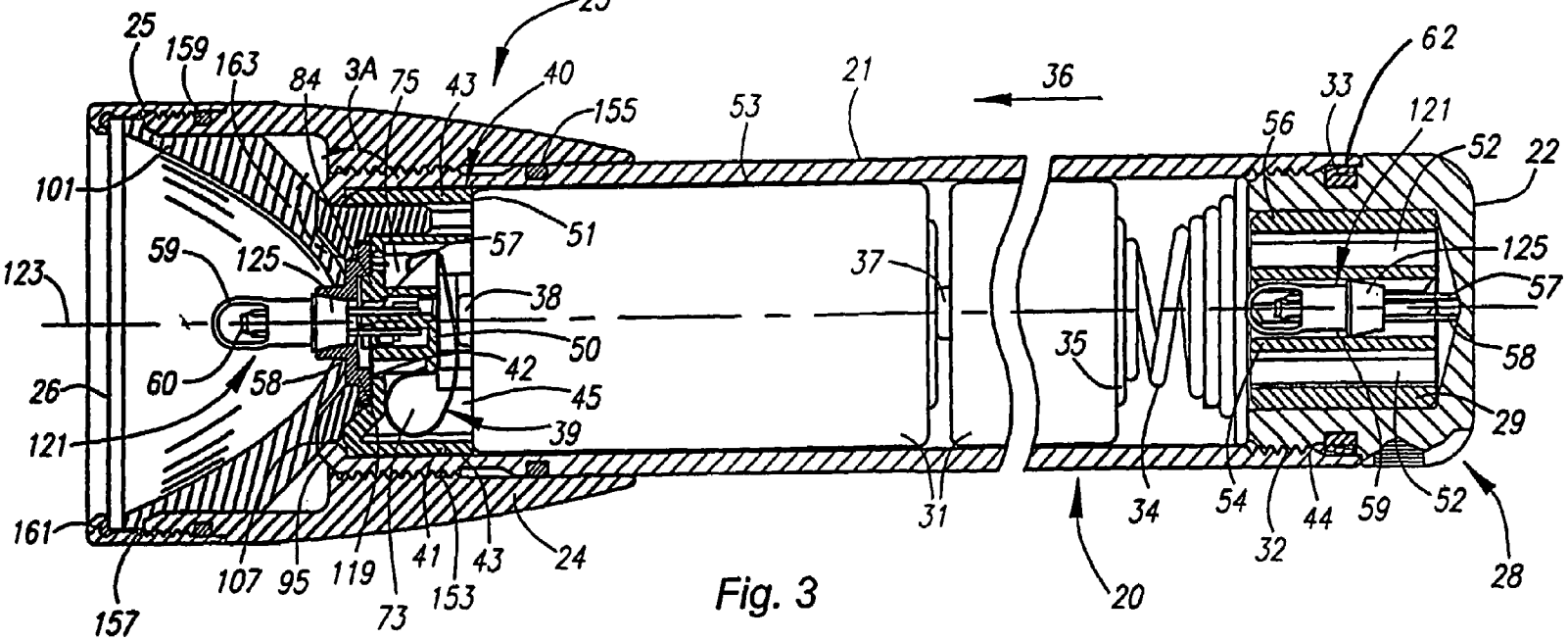
FIG. 3 is a cross-sectional view of the flashlight of FIG. 1 as taken through the plane indicated by 3-3 where the switch is shown in the "off" position.

The flashlight 20 is comprised of a barrel 21 enclosed at a rearward end by a tail cap 22 and having a head assembly 23 enclosing a forward end thereof. The head assembly of the present embodiment comprises a head 24 to which is affixed a face cap 25 which retains a lens 26. As best seen in FIG. 3, the head assembly 23 has a diameter greater than that of the barrel 21 and is adapted to pass externally over the exterior of the barrel 21. As is known in the art, barrel 21 may be provided with a textured surface 27 along its axial extent, preferably in the form of machined knurling.

Referring next to FIG. 2, the flashlight 20 is shown in perspective with the tail cap assembly 28 and head assembly 23 both disengaged from the barrel 21.

One distinct aspect of the present invention relates to the tail cap assembly 28. As shown in FIGS. 2, 3, 5, and 6 tail cap assembly 28 of the present embodiment includes tail cap 22 and conductive spring member 34. Tail cap assembly 28 also preferably includes a removable spare bulb holder 29 disposed in a cavity that opens to the end of the tail cap that engages barrel 21. Removable spare bulb holder 29 includes an inner hub that frictionally retains the spare lamp bulb 59. As shown, for example, in FIGS. 2 and 3, spokes 52 extend from the inner hub 54 to an outer hub 56 in frictional contact with the inner surface of the cavity formed in tail cap 22 to prevent damage to the spare lamp bulb 59.

Figure 5:
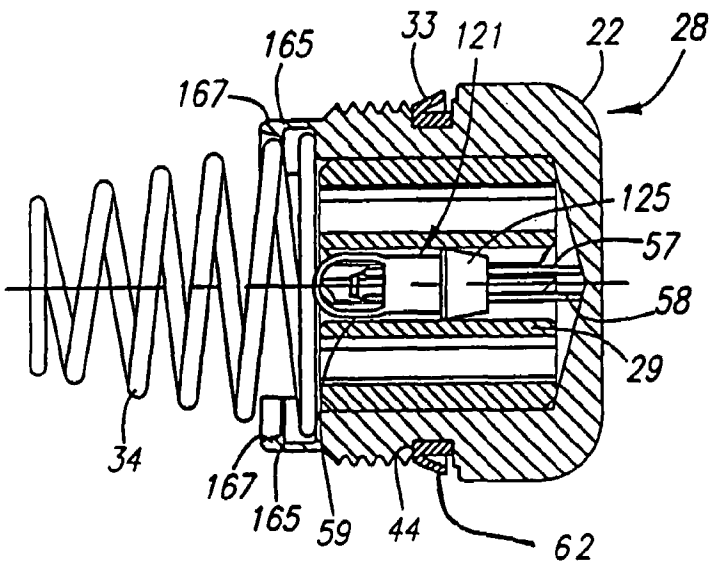
FIG. 5 is an enlarged cross-sectional view of the tail cap assembly of the flashlight of FIG. 1 taken through a plane rotated 90 degrees from the plane indicated by 3-3 and is provided in order to better illustrate one of the aspects of the present invention.

Tail cap 22 also preferably includes a region of external threads 32 for engaging matching threads formed on the interior of the barrel 21. However, other suitable means may also be employed for attaching tail cap 22 to barrel 21. A sealing element 33 may be provided at the interface between the tail cap 22 and the barrel 21 to provide a watertight seal. As best seen in FIGS. 3 and 5, sealing element 33 is preferably a one-way valve 62 in the form of a lip seal. However, as those skilled in the art will appreciate, it may also comprise an O-ring. One way valve 62 is retained in a circumferential channel 44 formed in tail cap 22. One-way valve 62 is oriented so as to prevent flow from outside into the interior of the flashlight 20, while simultaneously allowing overpressure within the flashlight to escape or vent to the atmosphere.

Threads 32 may be provided with a flattened top so as to create a spiral passage through the mating threads between the barrel 21 and the tail cap 22. Additionally, radial spines 46 may be formed in a mating flange of the tail cap 21 as shown in FIG. 2 to ensure that the end of barrel 21 does not provide a gas tight seal against the associated flange, thereby impeding the flow of overpressure gases from the interior of the flashlight.

The design and use of one-way valves in flashlights is more fully described in U.S. Pat. No. 5,113,326 to Anthony Maglica, which is hereby incorporated by reference.

The barrel 21 is seen to have an extent sufficient to enclose at least two dry cell batteries 31 disposed in a series arrangement. It will be appreciated by those skilled in the art, however, that barrel 21 may also be configured to include a single battery or a plurality of two or more batteries in either a series or a side-by-side arrangement.

Furthermore, while batteries 31 may comprise any of the known battery sizes, flashlight 20 according to the illustrated embodiment is particularly well suited for C or D sized batteries.

In a particularly preferred aspect of the present invention, the spring member 34 is disposed within the barrel 21 so as to form a direct electrical path between a case electrode 35 of an adjacent battery 31 and the inner surface 30 of the barrel 21. In alternative implementations of the invention, however, spring member 34 may also, or in the alternative, form an electrical path between the tail cap 22 and case electrode 35 of the rearmost battery 31.

The spring member 34 also urges the batteries 31 in a direction indicated by arrow 36. As a result, a center electrode 37 of the rearmost battery 31 is in electrical contact with the case electrode of the forwardmost battery 31, and the center electrode 38 of the forwardmost battery 31 is urged into contact with a first conductor 39 of switch 40.

Switch 40 constitutes another aspect of the present invention. Switch 40 is provided to open and close an electrical path between the batteries and one of the electrodes of lamp bulb 59. Thus, switch 40 allows the flashlight 20 to be selectively turned on and off.

Switch 40 is adapted to close the electrical path between the lamp bulb and batteries in response to axial movement of the head along the barrel and to open the electrical path in response to axial movement of the head in the opposite direction. It will be appreciated, however, that other types of switches that are commonly used in flashlights may also be employed with the other aspects of the invention described herein.

Figures 7, 8:
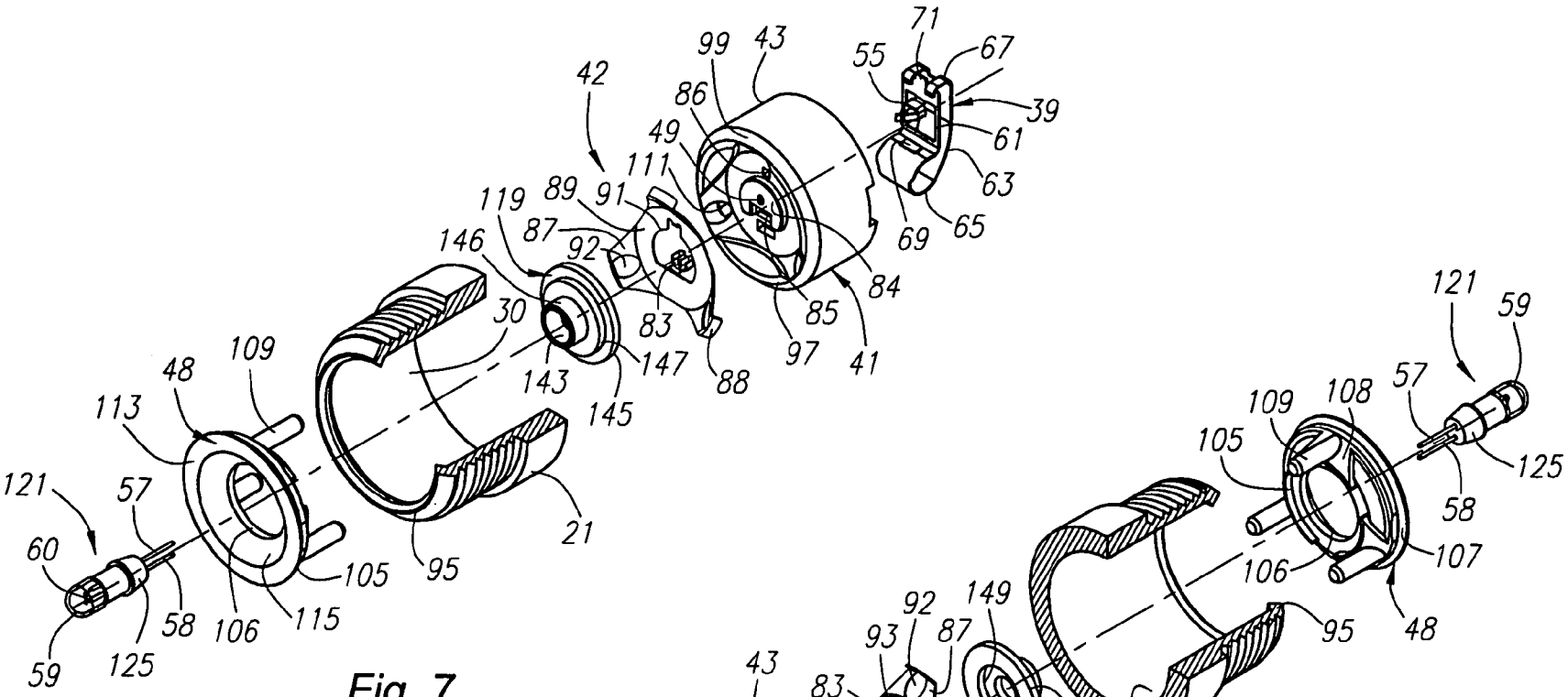
FIG. 7 is an exploded perspective view from the forward end of the flashlight of FIG. 1 illustrating the assembly of a preferred switch and a preferred bulb alignment mechanism in accordance with two separate aspects of the present invention with respect to the barrel of the flashlight.
FIG. 8 is an exploded perspective view from the rearward end of the flashlight of FIG. 1 illustrating the assembly of the preferred switch and bulb alignment mechanism with respect to the barrel of the flashlight.

As best seen in FIGS. 7 and 8, switch 40 comprises the first conductor 39, a lower insulator 41, a second conductor 42, and an upper insulated retainer 48.

Referring to FIGS. 3, 4, and 6-10, lower insulator 41 includes a sidewall 43 that defines a right circular cylinder. The diameter of the cylindrical wall defined by the sidewall 43 is dimensioned so that the lower insulator 41 may slide up and down against the inner surface 30 of barrel 21 without binding. At the same time, the diameter of the lower insulator is sufficient to prevent side-to-side movement of the lower insulator within the barrel. In addition, the lower insulator is preferably of sufficient length to prevent it from tilting with respect to the barrel. As a result of the foregoing arrangement, lower insulator 41 and barrel 21 will remain coaxial with respect to one another.

The first conductor 39 is mounted within a recess 45 formed in the bottom of insulator 41. The first conductor 39 is a resilient spring conductor adapted to be compressible in the direction of arrow 36. Conductor 39 is configured so that when mounted within recess 45 it does not extend beyond sidewall 43 of the lower insulator 41. As a result, if batteries 31 are inserted backwards into barrel 21, so that their case electrodes are pointing forward, an electrical circuit is not formed. When the batteries are inserted correctly as shown in FIG. 3, however, the center electrode of the forwardmost battery is urged into contact with, and compresses, the first conductor 39.

Sidewall 43 is sized to abut against an end 51 of battery casing 53 of the forwardmost battery for a given size battery. In addition, the central portion of recess 45 is dimensioned to be deeper than the distance center electrode 38 extends beyond the end of the battery casing for the given size battery. As flashlight barrel 21 is typically sized to accommodate specific standard size batteries 31, the lower insulator 41 will also be appropriately located within the barrel 21 to abut against end S1 of battery casing 53. In view of the foregoing relationships, the switch of the present embodiment helps to avoid impact stresses on the center electrode 38 of the forwardmost battery.

The first conductor 39 preferably comprises a leaf spring which allows limited travel of the batteries towards and away from the switch assembly without losing physical or electrical contact between the center electrode 38 of the forwardmost battery 31 and the first conductor 39. The spring action of conductor 39 provides a dampening effect that further helps to prevent damage to the center electrode 38 in the event the flashlight is dropped; it also helps to maintain electrical contact in such situations.

First conductor 39 includes a first contact 55 that is disposed in a slot 47 provided in a support pedestal 50 formed in the central region of recess 45. Slot 47 extends in an axial direction and is in communication with hole 49 provided in the forward surface of the insulator receptacle 41. As a result, a first terminal electrode 57 of a lamp bulb 59, for example a bi-pin lamp bulb, may extend through hole 49 into slot 47. Contact 55 is adapted to frictionally receive and retain electrode 57 of the lamp bulb 59.

Figure 6:
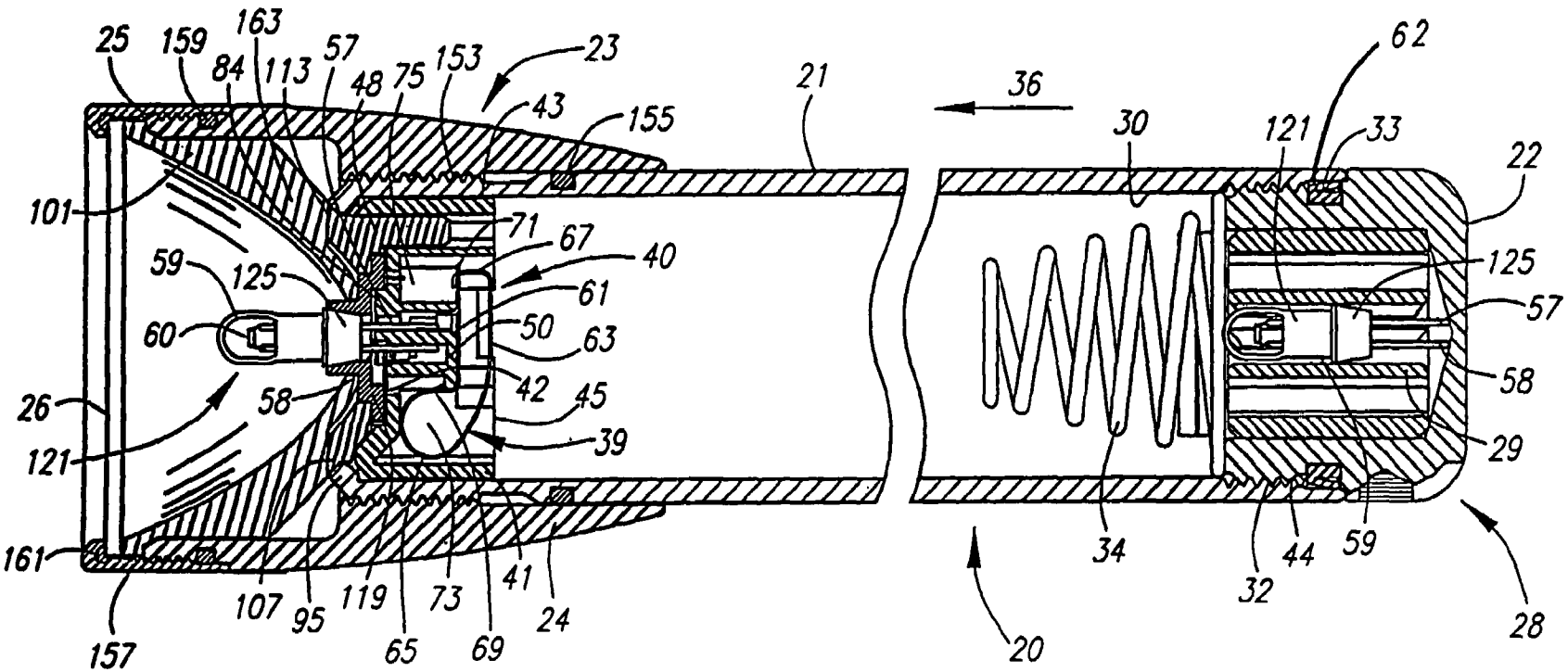
FIG. 6 is a cross-sectional view of the flashlight of FIG. 1 as taken through the plane indicated by 3-3 without including batteries.

The first conductor 39 may be integrally formed from a strip of resilient metal of suitable width by stamping appropriate cuts in the strip and then bending the cut strip. The first conductor 39 is preferably formed to have a base arm 61 and a leaf spring arm 63 with a circular loop 65 connecting the two at one end. Loop 65 urges leaf spring 63 away from base arm 61. Hooks 67 are provided at the end of the leaf spring arm 63 that is opposite loop 65 to grip onto the corresponding end of the base arm 61. As best seen in FIG. 6, hooks 67 keep leaf spring 63 from springing to its relaxed position in the absence of a compressive force being applied by batteries 31 in the direction of base arm 61. Thus, hooks 67 maintain a desired spacing between base arm 61 and leaf spring arm 63 in the absence of an external force. The spacing between leaf spring 63 and base arm 61 is advantageously sized to be greater than the distance center electrode 38 extends beyond the end of the battery casing for the size of battery for which flashlight 20 is designed. As a result, center electrode 38 of battery 31 will not contact base arm 61, which is rigidly supported by support pedestal 50 formed in recess 45, again helping to avoid impact stresses on the center electrode 38 of the battery.

The first conductor 39 may be secured within recess 45 in a variety of ways. In the present embodiment, conductor 39 is secured within recess 45 by appropriately shaping circular loop 65 and providing conductor 39 with first and/or second tabs 69, 71.

As best seen in FIG. 6, loop 65 is preferably formed so as to impart a kidney-like shape to conductor 39. As a result, loop 65 extends into a first portion 73 of recess 45 provided between a first sidewall 79 of support pedestal 50 and the inner surface of sidewall 43. Loop 65 is also preferably dimensioned so that its opposing sides are compressed between support pedestal 50 and the inner surface of sidewall 43. A first tab 69 may be provided on the outer circumference of loop 65 adjacent support pedestal 50 to engage a ledge 77 provided in sidewall 79 when loop 65 is fully inserted into the portion 73 of recess 45. When tab 69 engages ledge 77 base arm 61 should be abutting support pedestal 50 and contact 55 should be fully inserted into slot 47. The foregoing configuration permits the loop end of conductor 39 to be mechanically fastened to support pedestal 50 in a durable manner.

Figure 10:
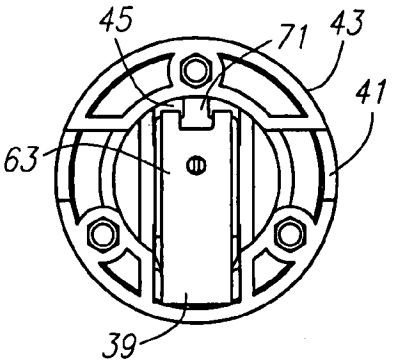
FIG. 10 is a view of the rearward end of the switch.
Figure 9:
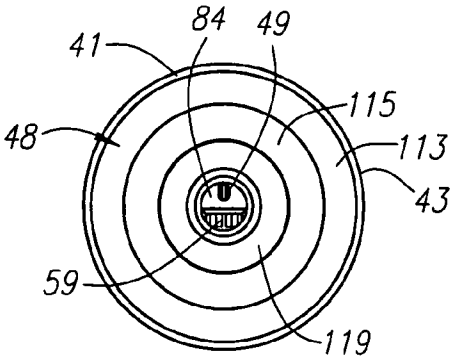
FIG. 9 is a view of the switch of FIG. 7 from the forward end of the flashlight.

The end of base arm 61 opposite loop 65 may be secured to lower insulator 41 with the aid of tab 71. For example, as best seen in FIG. 10, tab 71 may be sized to engage the inner surface of sidewall 43 to frictionally hold the base arm to lower insulator 41. Thus, by appropriately dimensioning base arm 61 and tab 71, the end of conductor 39 opposite loop. 65 may also be mechanically fastened within recess 45 while still permitting leaf spring arm 63 to be freely compressed.

Figure 4:
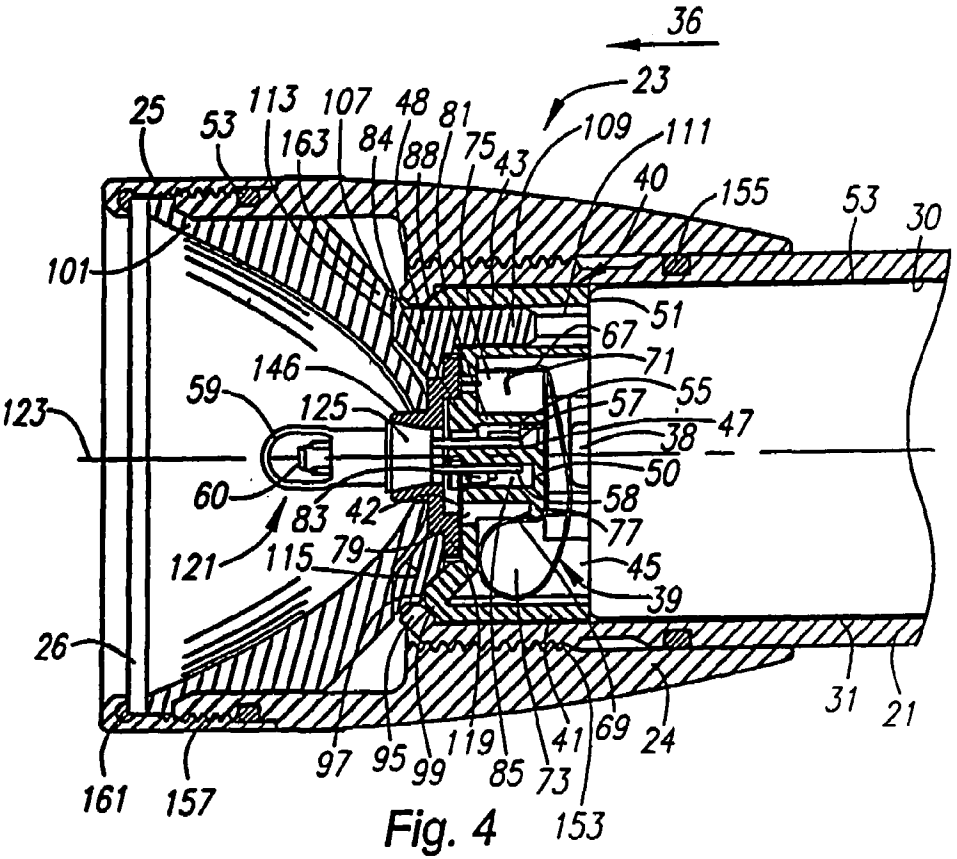
FIG. 4 is an enlarged cross-sectional view of the forward end of the flashlight of FIG. 1 as taken through the plane indicated by 3-3 where the switch is shown in the "on" position.

As illustrated in FIGS. 3-4, when leaf spring arm 63 is compressed, hooks 67 generally translate in an axial direction into a second portion 75 of recess 45 provided between a second side 81 of support pedestal 50 and the inner surface of sidewall 43.

Conductor 39 may also be secured within recess 45 by sizing slot 47 to frictionally receive contact 55.

Second conductor 42 is adapted to provide an electrical conduction path between the second terminal electrode 58 of lamp bulb 59 and barrel 21 when switch 40 is closed. To achieve the desired conduction path, in the present embodiment, second conductor 42 is interposed between the lower insulator 41 and the upper retainer 48. In addition, the second conductor 42 is configured so that a second contact 83, which may be formed integrally with conductor 42, is received in a slot 85 provided in the forward surface of insulator 41. Slot 85 extends in an axial direction of the insulator and is generally offset from the axis of insulator 41 an appropriate distance for receiving the second terminal electrode 58 of lamp 59 while still allowing the filament 60 of the lamp to be centered on the axis of the insulator. Contact 83, which is received in slot 85, is adapted to frictionally receive and retain terminal 58 within the slot.

If desired, slot 85 may be sized to frictionally receive contact 83 to facilitate assembly of switch 40.

As best illustrated in FIGS. 7 and 8, second conductor 42 also preferably includes a central body portion 89 and one or more arms 87 that extend from the central body portion in a radial direction toward the sidewall 43 of insulator 41. Arms 87 are configured to make electrical contact with barrel 21 when switch 40 is closed. For example, in the present embodiment, three arms 87 are spaced symmetrically 120° apart and are configured to come into contact with lip 95 of barrel 21 when switch 40 is closed.

Central body portion 89 is preferably interposed between lower and upper insulators 41, 48 so that it is orthogonal to the central axis of the lower insulator 41, and thus flashlight 20. To help orient conductor 42 relative to insulator 41, central body portion 89 may include a hole 91 that axially extends through the conductor for receiving a mating protrusion or pedestal 84 provided on the forward surface of insulator 41. For example, in the present embodiment, hole 91 is generally shaped like a segment of a circle, and pedestal 84 has a cross-sectional profile that matches the shape of hole 91. As a result, once pedestal 84 is received in hole 91, conductor 42 is prevented from rotating relative to insulator 41. Although hole 91 and pedestal 84 of the present embodiment employ the shape of a segment of a circle, it will be appreciated by those skilled in the art that a wide variety of other shapes may also be used.

In the present embodiment, contact 83 is attached to central body portion 89 at the midpoint of the chord that defines the hole 91. A protrusion 93 may be provided opposite contact 83 along the arc that defines the hole 91. If protrusion 93 is included on conductor 42, it is preferably configured to be received by a mating hole 86, and thus may be used to further help properly orient conductor 42 relative to insulator 41.

As best seen in FIGS. 4 and 7, the forward surface of insulator 41 is preferably recessed relative to a leading edge 97. Edge 97 may be annular in shape and is preferably formed so that it is concentric with sidewall 43. A beveled edge 99 preferably extends radially between sidewall 43 and leading edge 97. Beveled edge 99 may be beveled at a wide variety of angles. However, an angle of approximately 45° with respect to the central axis of the insulator 41, and thus barrel 21, is preferred.

Central body portion 89 of conductor 42 is positioned adjacent the recessed forward surface of insulator 41. As a result, arms 87 angle forward from central body portion 89 toward the leading edge 97 of insulator 41. The ends of each arm 88 are bent to form a barrel contact 88 that is configured to cup around leading edge 97 and rest against beveled edge 99.

Absent further assembly, the lower insulator 41 is urged to move in the direction indicated by the arrow 36, by the action of the spring member 34, until barrel contacts 88 come into contact with lip 95 of the barrel 21. To minimize resistance and maximize contact area, lip 95 is preferably angled at the same angle as beveled edge 99 with respect to the central axis of the flashlight. In addition, lip 95 and edge 99 preferably form an acute angle with respect to the central axis of the flashlight so that the contact area of contacts 88 can be increased for a given distance that lip 95 extends radially in towards the axis of the flashlight.

Upper insulated retainer 48 is partially disposed external to the end of the barrel 21 whereat the lower insulator 41 is installed. Retainer 48 is configured to attach to lower insulator 41 and to prevent axial movement of the lower insulator 41 in a direction opposite arrow 36 beyond a predetermined distance from lip 95. Thus, insulated retainer 48 keeps lower insulator 41 from falling to the rear of barrel 21, and potentially out the tail end of the flashlight, in the absence of batteries 31 being installed in the flashlight. In addition, the rearward facing surface 108 of retainer 48 is adapted to press the central body portion 89 of conductor 42 firmly against the forward surface of the lower insulator, and the forward facing surface is adapted to engage reflector 101. By pushing the central body portion 89 against the forward recessed surface, the upper insulated retainer 48 also pulls the barrel contacts 88 firmly against beveled edge 99. As a result, switch 40 will only activate, as will be more fully described below, when head assembly 23 is rotated by a desired amount relative to barrel 21.

In the present embodiment, the upper insulated retainer 48 comprises an annular body 105 having a central hole 106 extending therethrough. Body 105 is generally dimensioned so that it can be received within the inner diameter of lip 95 up to a rim 107, which has a larger diameter than the inner diameter of lip 95 and which is formed on the forward end of the retainer 48. Body 105 is also configured to provide a predetermined amount of spacing between rim 107 and beveled edge 99 when retainer 48 is attached to lower insulator 41.

A plurality of extensions, or legs, 109 extend from the rear-facing surface 108 of the annular body for attaching retainer 48 to lower insulator 41. Three extensions are employed in the present embodiment, with each extension being spaced 120 degrees from the other extensions so as to be in alignment with and pass through holes 92 provided in each arm of the second conductor 42. In addition, extensions 109 are configured to mate with corresponding bores 111 provided in the lower insulator 41. Extensions 109 and bores 111 are preferably sized to provide an interference fit between the two. The interference fit may be sufficiently strong to prevent switch 40 from being dismantled without its destruction. However, the interference fit need only be strong enough to keep switch 40 from coming apart during normal usage of the flashlight.

While retainer 48 is attached to lower insulator 41 in the present embodiment using legs 109 and bores 111, it will be appreciated by those skilled in the art that other suitable means of attachment may also be employed. For example, legs 109 may alternatively extend from the forward surface of lower insulator 41 and bores 111 may be provided in retainer 48.

The forward facing surface of retainer 48 is provided with a shoulder 113 for engaging reflector 101. Shoulder 113 is shaped like an annulus in the present embodiment. A recessed surface 115 that extends concentrically inward from the inner diameter of shoulder 113 may also be provided on the forward facing surface to accommodate a central portion of the reflector 101.

Lamp bulb 59 may be directly mounted to switch 40 so that the electrodes 57 and 58 are in electrical contact with the first and second contacts 55 and 83 of the first and second conductors. In the present embodiment, however, a lamp bulb and lamp base combination 121 according to a preferred aspect of the present invention is employed together with a lamp base receiver 119 to ensure that the filament 60 of lamp bulb 59 is aligned with the principal axis 123 of the flashlight's reflector 101.

Figure 12:
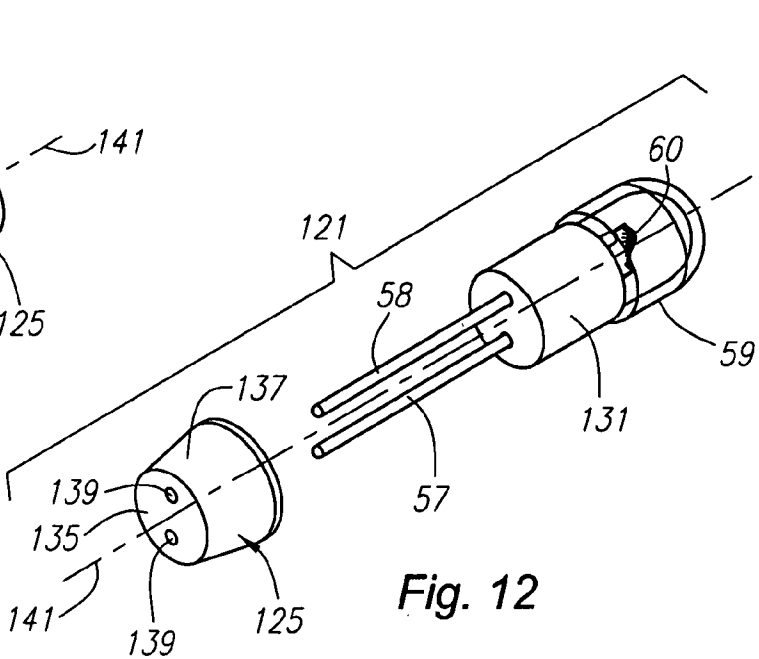
FIG. 12 is an enlarged, exploded perspective view of the bi-pin lamp bulb and the lamp base combination shown in FIG. 11 as viewed from the base end of the combination.
Figure 11:
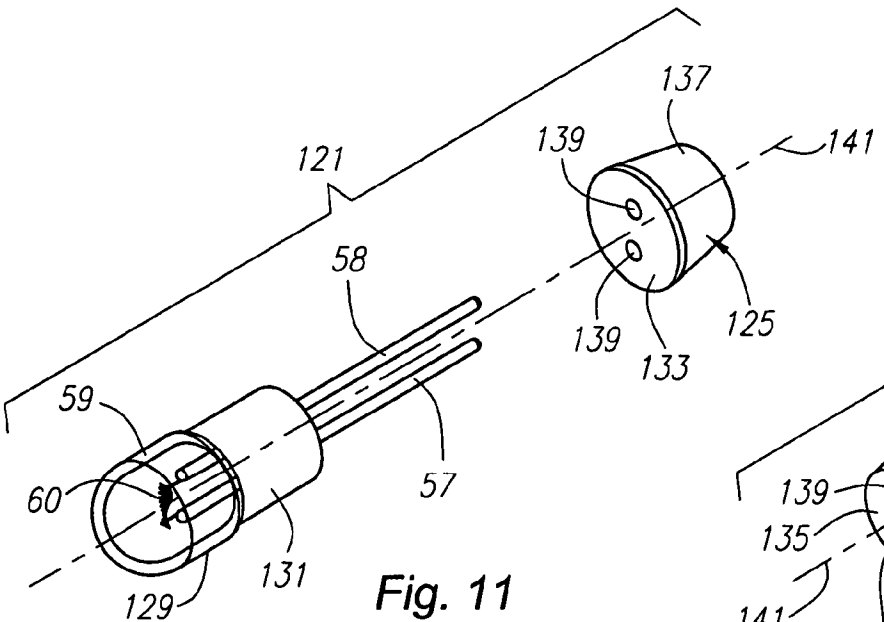
FIG. 11 is an enlarged, exploded perspective view of an embodiment of a bi-pin lamp bulb and lamp base combination according to an aspect of the present invention.

As shown in the exploded views of combination 121 provided in FIGS. 11 and 12, combination 121 comprises lamp 59 and lamp base 125.

Lamp bulb 59 may be a standard bi-pin lamp bulb. Typically lamp bulb 59 will include a bulb portion 129 at one end that contains the light emitting filament 60. The other end of the lamp bulb includes a glass bead 131 for sealing the bulb end. The first and second terminal electrodes 57 and 58 extend through the glass bead and into the bulb portion. The opposing ends of filament 60 are attached to the ends of electrodes 57 and 58 that extend into the bulb portion of the lamp.

During operation of lamp 59, the hottest portion of filament 60, and thus that portion which emits the most light, will occur at the middle of the overall length of the wire filament extending between the ends of the electrodes, hereinafter referred to as the "center" of the filament. However, the center of the filament is oftentimes not located on the axis of the lamp bulb. This may be due to a number of factors. For example, the filament may be more tightly wound at one end versus the other end, thus shifting the center of the filament closer to the end of one electrode than the end of the other electrode and closer to one side of the lamp bulb. Even if the filament is uniformly wound, the filament may be attached to electrodes 57, 58 so that its center is not aligned with the axis of the lamp bulb. Furthermore, even if the center of the filament 60 is properly positioned equidistant between the ends of the electrodes 57, 58, misalignment may occur if the ends of the electrodes themselves are not equally spaced from the axis of the lamp bulb or if the ends of the electrodes are not properly positioned on a common plane with the central axis of the lamp bulb.

Similar misalignment problems are experienced with other types of bulbs used in the flashlight art.

Lamp bulb 59 is secured to base 125 so that the filament is centered on, or aligned with, a predetermined axis extending through the base 125. Base 125 preferably comprises a body of revolution. In the present embodiment, as shown in FIGS. 11 and 12, base 125 generally comprises a frustum of a right circular cone having a base end 133, a truncated end 135 parallel to the base end, and a tapered sidewall 137. Two holes 139 extend through the base 125 in the direction of the axis of revolution 141 for receiving electrodes 57, 58. The lamp base 125 may be manufactured from a ceramic to prevent melting of the lamp base from the high temperatures generated by some bulbs during operation of the flashlight, as well as to insulate electrodes 57 and 58 from one another.

Axis 141 comprises the predetermined axis in the present embodiment. Accordingly, tapered surface or sidewall 137 is concentric about the predetermined axis. Holes 139 are preferably offset from axis 141 by equal distances. Holes 139 are also preferably formed in base 125 so that the axis of holes 139 fall on a common plane with axis 141 of base 125.

The terminal electrodes 57, 58 of the lamp bulb 59 extend through holes 139 and the end of glass bead 131 opposite bulb portion 129 is disposed adjacent to the base end of lamp base 125.

Because the location of the center of filament 60 will vary from lamp bulb to lamp bulb with respect to the central axis of lamp bulb 59, in the present embodiment holes 139 in base 125 are sized to have an inner diameter that is greater than the diameter of electrodes 57, 58. Sufficient clearance or play is provided by holes 139 to permit bulb 59 to be laterally adjusted with respect to the predetermined axis 141 of base 125 during the manufacturing alignment process so as to bring the center of filament 60 in alignment with the predetermined axis.

To align the center of filament 60 with the predetermined axis 141, lamp bulb 59, for example a bi-pin lamp bulb, is initially inserted into base 125 so that electrodes 57, 58 extend through holes 139 and the glass bead portion 131 of the lamp bulb is adjacent the base end 133 of the base. Lamp bulb 59 is then laterally adjusted or displaced with respect to base 125 to bring the center of filament 60 into alignment with the predetermined axis 141. In the present embodiment, the play between the inner walls of holes 139 and electrodes 57, 58 permits limited side-to-side movement in all lateral directions. The lateral adjustment may be carried out manually or by an automated means. Further, an optical bench or other suitable means known in the optics art may be used to determine when filament 60 is properly aligned with the predetermined axis 141. Preferably the filament is aligned so that its center is displaced 0.003 inches or less from the predetermined axis 141, and more preferably 0.001 inches or less from the predetermined axis. Lamp bulb 59 is preferably powered during the alignment process to facilitate identification of the center of the filament and its alignment with axis 141. If lamp bulb 59 is powered during the alignment process, the optical equipment employed in the optical bench is preferably adapted, as will be appreciated by those skilled in the art, to detect the hottest or brightest portion of filament 60, and hence its center once the filament is properly aligned with axis 141, lamp bulb 59 may be secured or attached to base 125 using an adhesive or other suitable means to preserve the alignment of the center of the filament 60. Although a variety of adhesives may be used, a fast, UV curing adhesive is preferred so that once filament 60 is aligned with predetermined axis 141, the adhesive may be rapidly cured by exposing it to a UV light source. The adhesive may be applied to the base or opposing surface of glass bead 131 prior to insertion of the electrodes into base 125. Alternatively, the adhesive may be applied subsequent to the insertion of electrodes 57, 58 into base 125. If the adhesive is applied prior to insertion of lamp bulb 59 into base 125, however, obviously it should have a sufficient set time to permit the center of the filament 60 to be aligned with the predetermined axis before setting.

Base 125 of the lamp bulb and lamp base combination 121 is removably seated in a complementary bore 143 that extends through the lamp base receiver 119, which is mounted adjacent the forward end of barrel 21, and hence a central opening provided in reflector 101 coaxial with the principal axis of the reflector. Thus, for example, in the present embodiment the forward end portion of bore 143 is provided with a hollow conical shape, the slope of which matches the taper of sidewall 137 of base 125.

Lamp base receiver 119 is mounted adjacent the forward end of flashlight 20 so that lamp bulb 59 extends through the central opening in the reflector and the predetermined axis of base 125, and thus the center of filament 60, is aligned with the principal axis 123 of the reflector 101 when the flashlight is fully assembled. Because the principal axis of reflector 101 coincides with the central axis of barrel 21 in the present embodiment, this may be accomplished in the present embodiment by mounting lamp base receiver 119 adjacent the forward end of barrel 21 so that the central axis of bore 143 is aligned with the central axis of barrel 21, and hence the principal axis of reflector 101. In this configuration, the tapered surface that defines bore 143 will be concentric about the principal axis of the reflector. Because the matching tapered surface of sidewall 137 of base 125 is concentric about the predetermined axis, when the tapered surface of base 125 is seated against the matching tapered surface defining bore 143, the predetermined axis will be aligned with the principal axis.

Lamp base 125 comprises a frustum of a right circular cone. A tapered base, such as the frustum shown in the accompanying drawings, has self-centering characteristics provided by the mating tapered surfaces of the base and bore 143. While sidewall 137 may be tapered over a wide range of angles with respect to the axis of revolution 141, the greater the angle the more difficult it becomes to maintain filament 60 on center with the axis of bore 143 when base 125 is seated in bore 143. As a result, sidewall 137 is preferably tapered at an angle of between 5° and 60° with respect to the axis of revolution. More preferably, sidewall 137 is tapered at an angle of between 5° and 20° with respect to the axis of revolution. Regardless of the angle of taper for sidewall 137, however, complementary bore 143 should have a matching slope.

In the present embodiment, lamp base receiver 119 includes a base portion 145 and a tubular extension 146 projecting from the forward surface of the base portion and having a cylindrical outer surface. Bore 143 extends in an axial direction through the tubular extension and base portion. The outer diameter of tubular extension 146 is sized to slide within the central opening provided in reflector 101.

Receiver 119 is mounted on the forward end of barrel 21 in the present implementation of the invention by interposing base portion 145 between retainer 48 and lower insulator 41. To ensure that the central axis of bore 143 is aligned with the axis of barrel 21, the forward facing surface, rear facing surface or both of the base portion 145 can be provided with alignment features adapted to engage complementary alignment features provided on the opposing surfaces of retainer 48 and lower insulator 41. For example, in the present embodiment the forward facing surface of the base portion 145 is provided with a cylindrical step 147 that is coaxial with the central axis of bore 143 and that is adapted to seat within the central hole 106 of the retainer 48. As central hole 106 is configured to be coaxial with the axis of barrel 21 when retainer 48 is attached to insulator 41, bore 143 will also be coaxial with barrel 21. Similarly, the rear facing surface of the base portion is provided with a cylindrical recess 149 sized to receive the pedestal 84 provided on the forward facing surface of insulator 41, thus providing further assurance that the axis of bore 143 will be aligned with the axis of barrel 21.

When base 125 of combination 121 is seated in bore 143, electrodes 57 and 58 of the lamp bulb 59 pass out of the lower end of the base 125 and lamp base receiver 119. The first electrode 57 further extends through hole 49 in the lower insulator 41 and into electrical contact with the first contact 55. The second electrode extends into axial slot 85 provided in the forward surface of lower insulator 41 and into electrical contact with the second contact 83. As a result, electrodes 57 and 58 are also in electrical contact with the first conductor 39 and the second conductor 42, respectively. The electrodes 57 and 58 are frictionally held in place by contacts 55 and 83, respectively, which in turn keeps base 125 seated against the wall of bore 143. As a result, the alignment of filament 60 is maintained with respect to the axis of barrel 21.

Moreover, if combination 121 is replaced with a spare lamp bulb, lamp base combination 121, such as the one stored in spare bulb holder 29 provided in tail cap 22, filament 60 of the spare bulb 59 will still be aligned with the axis of barrel 21, and hence the principal axis of reflector 101 as described more fully below. This is because the center of the filament 60 of each lamp bulb has been aligned with the predetermined axis of the lamp base 125. As a result, the center of the filament 60 of each lamp bulb will be automatically aligned with the axis of barrel 21, and hence the principal axis of the reflector, when the base 125 is seated in bore 143.

Although lamp base receiver 119 is shown as being formed separately from retainer 48, it will be appreciated that lamp base receiver 119 may also be integrally formed with retainer 48. Receiver 119 is preferably formed separately from retainer 48, however, so that receiver 119 may be formed from a suitable metal, such as aluminum. An advantage of having a metal receiver 119 is that it will act as a heat sink. Further, as receiver 119 is in contact with the second conductor 42, which in turn will be in contact with lip 95 of barrel 21 when the flashlight is turned on, heat will be carried away from the area surrounding bulb 59 through receiver 119 and conductor 42 to barrel 21. In addition, because conductor 42 includes a plurality of arms 87 with barrel contacts 88, the amount of heat that can be conducted away from lamp bulb 59 is significantly greater than in previously known switch designs that are activated by rotation of a head assembly. As a result, higher amperage bulbs may be used in flashlight 20 without risking thermal damage to insulated retainer 48 or lower insulator 41.

The head assembly 23 is installed external to the barrel 21 by engaging threads 153 formed on the interior surface of the head 24 with mating threads formed on the exterior surface of the barrel 21. A sealing element 155, such as an O-ring, may be installed around the circumference of the barrel 21 adjacent to the threads to provide a water tight seal between the head assembly 23 and the barrel 21. The substantially parabolic reflector 101 is configured to be disposed within the outermost end of the head 24, wherein it is rigidly held in place by the lens 26 which is in turn retained by the face cap 25 which is threadedly engaged with threads 157 formed on the forward portion of the outer diameter of the head 24. The reflector 101 is designed such that the principal axis 123 of the reflector 101 coincides with the axis of the head assembly and the axis of the barrel when the flashlight is fully assembled. As a result, filament 60 of lamp bulb 59, which is aligned with the central axis of barrel 21, will also be centered with respect to the principal axis of the reflector when the flashlight is fully assembled, thereby ensuring optimal optical characteristics for the flashlight 20.

For example, by using lamp and base combination 121 in conjunction with base receiver 119, manufacturing tolerances may be readily maintained so that the center of filament 60 is displaced by no more than 0.003 inches from the principal axis 123 of reflector 101. It has been found, however, that tolerances may be readily maintained so that the filament 60 is displaced by 0.001 inches or less from the principal axis 123 of reflector 101 in the assembled flashlight. In general, tolerances are preferably maintained so that the center of filament 60 is disposed as close as possible to the principal axis of reflector 101 in the assembled flashlight, with coincidence being ideal.

A sealing element 159, such as an O-ring, may be incorporated at the interface between the face cap 25 and head 24 to provide a watertight seal. A sealing element 161 may also be incorporated at the interface between the face cap 25 and the lens 26 to provide a watertight seal.

The rear-facing surface of reflector 101 is provided with an abutment 163 that surrounds the central opening formed in reflector 101 for passage of lamp bulb 59 and tubular extension 146. Abutment 163 may, for example, comprise a concentrically formed ledge around the outer surface of reflector 101. Alternatively, abutment 163 may comprise a plurality of ledges formed in a series of ribs or fins provided on the exterior surface of reflector 101.

Figure 3A:
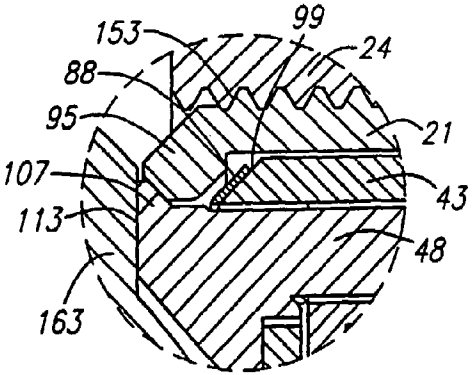
FIG. 3A is an enlarged view of the portion of the flashlight shown in FIG. 3 that is encircled by circle 3A.

When head 24 is fully screwed onto the barrel 21 by means of the threads 153, abutment 163 abuts against shoulder 113 of retainer 48, urging it in a direction counter to that indicated by arrow 36. The upper insulator receptacle 47 then pushes lamp base receiver 119 and the lower insulator 41 in the same direction, thereby providing a space between the barrel contacts 88 and the lip 95 on the forward end of the barrel 21. The second conductor 42 is thus separated from contact with the lip 95 of the barrel 21 as shown in FIG. 3A, and the electrical circuit is opened.

Referring to FIG. 4, appropriate rotation of the head 24 about the axis of the barrel 21 causes the head assembly 23 to move in the direction of arrow 36 through the engagement threads 153. Upon reaching the relative position indicated in FIG. 4, the head assembly 23 has progressed a sufficient distance in the direction of arrow 36 such that the reflector 101 has moved a like distance enabling the retainer 48, the lamp base receiver 119, and the lower insulator 41 to be moved by the urging of the spring member 34 translating the batteries 31 in the direction of the arrow 36, to the illustrated position. In this position, the barrel contacts 88 have been brought into contact with the lip 95 on the forward end of the barrel 21, which closes the electrical circuit.

The head assembly 23 may be rotated further so as to cause further translation of the head assembly 23, including the reflector 101, in the direction indicated by arrow 36. During this operation the upper insulated retainer 48 remains in a fixed position relative to barrel 21. Thus, the lamp bulb 59 and the optically centered filament 60 of the lamp bulb 59 also remain in a fixed position. The shifting of the reflector 101 relative to the lamp bulb 59 during this additional rotation of the head assembly produces a relative shift in the position of the filament of the lamp bulb 59 with respect to the focus of the parabola of the reflector 101, thereby varying the dispersion of the light beam emanating from the lamp bulb 59 through the lens 26. The shifting of the reflector 101 is substantially limited to movement along the shared axis of the barrel 21 and the reflector 101, thus preserving the alignment of the filament 60 of the lamp bulb 59 with the principal axis of the reflector 101.

Referring to FIGS. 2, 3, 5 and 6, the tail cap assembly 28 according to one of the separate aspects of the present invention is now more fully described. Tail cap assembly 28 includes a spring member 34 that generally comprises a tapered coil spring. A base coil in spring member 34 is provided with an oval shape having a major diameter that is sufficient to allow the spring member 34 to be in direct contact with the inner surface 30 of barrel 21 when the tail cap assembly is inserted in barrel 21 as shown in FIG. 3. The minor diameter of the oval-shaped coil of spring member 34 is sized to be received by opposing ears 165 provided on the forward end of tail cap 22. Ears 165 act as a spring seat. In the present embodiment, ears 165 are curved to follow the circumference of the forward end of tail cap 22 and are provided with lips 167 on their opposing faces. Lips 167 are designed to retain spring member 34 to tail cap 22 while allowing the major diameter of the oval-shaped coil to project out opposing openings formed between the ears 165 as best seen in FIG. 2. When the tail cap 22 is engaged to the barrel 21, the design of the spring member 34 allows for direct electrical contact between the case electrode 35 of the rearmost battery 31 and the inner surface 30 of the barrel 21. As a result, tail cap 22 may be eliminated from the electrical circuit of the flashlight. This in turn eliminates the need to machine or mask the tail cap if it is coated with a non-conductive coating, such as when the tail cap is anodized or painted. Furthermore, the number of parts required in comparison to currently known tail cap assemblies for flashlights that do not include the tail cap as part of the electrical circuit is reduced.

Referring to FIGS. 3, 4, and 5 the electrical circuit of flashlight 20 according to the present embodiment of the invention will now be described. Electrical energy is conducted from the rearmost battery 31 through its center contact 37 which is in connection with the case electrode 36 of the forwardmost battery 31. Electrical energy is then conducted from the forwardmost battery 31 through its center electrode 38 to the first conductor 39 which is coupled to the lamp electrode 57. After passing through filament 60 of the lamp bulb 59 the electrical energy emerges through lamp electrode 58 which is coupled to the second conductor 42. When the head assembly 23 has been rotated about the threads 153 to the position illustrated by FIG. 3, the barrel contacts 88 of second conductor 42 do not contact the lip 95 of the barrel 21, thereby resulting in an open electrical circuit. However, when the head assembly 23 has been rotated about the threads 153 to the position illustrated in FIG. 4, the barrel contacts 88 of the second conductor 42 are now pressed against the lip 95 by the lower insulator 41 being urged in the direction of the arrow 36 by the spring member 34. In this configuration, electrical energy may then flow from the barrel conductor 42 into to the lip 95, through the barrel 21, and into the spring member 34, the spring member 34 being in electrical contact with the case electrode 35 of the rearmost battery 31. By rotating the head assembly 23 about the threads 153 such that the head assembly 23 moves in the direction counter to that indicated by the arrow 36, the head assembly 23 may be restored to the position illustrated in FIG. 3, thereby opening the electrical circuit and turning off the flashlight.

An additional utilization of the flashlight 20 in accordance with the present invention is achieved by rotating the head assembly 23 about the threads 153 in a direction causing the head assembly to translate relative to the barrel 21 in the direction of the arrow 36 of FIG. 3 whereby the electric circuit will be closed and the lamp bulb 59 will be illuminated. Continued rotation of the head assembly 23 in that direction will enable the head assembly 23 to be completely removed from the forward end of the flashlight 20. By placing the head assembly 23 upon a substantially horizontal surface such that the face cap 25 rests on the surface, the tail cap 22 of the flashlight may be inserted into the head to hold the barrel 21 in a substantially vertical alignment. Since the reflector 101 is located within the head assembly 23, the lamp bulb 45 will omit a substantially spherical or candle-like illumination, thereby providing an ambient light level.

In a preferred implementation of the illustrated embodiment, the barrel 21, tail cap 22, head 23, and face cap 25, forming all of the exterior surfaces of the flashlight 20 are manufactured from aircraft quality, heat treated aluminum, which is anodized for corrosion resistance. The sealing elements 33, 155, 159, and 161 preferably provide atmospheric sealing of the interior of the flashlight 20. All interior electrical contact surfaces are preferably appropriately machined to provide efficient electrical conduction. The reflector 101 is provided with a computer-generated parabolic reflecting surface that is vacuum aluminum metallized to ensure high precision optics.

Various embodiments of improved high quality flashlights and their respective components have been presented in the foregoing disclosure. While preferred embodiments of the herein invention have been described, numerous modifications, alterations, alternate embodiments, and alternate materials may be contemplated by those skilled in the art and may be utilized in accomplishing the various aspects of the present invention. For example, while combination 121 and lamp base receiver 119 have been illustrated in the described embodiment to be used in a particularly preferred switch design, the use of lamp base receiver 121 and combination 121 is not so restricted. Rather, the lamp base receiver and combination 121 disclosed herein may be employed in flashlights having a wide variety of other configurations and switch designs, as well as switch placements within flashlight 20. All that is needed is for the lamp base receiver 119 to be mounted adjacent the central opening in reflector 101 so that when the base is seated in the base receiver the lamp bulb extends through the central opening in the reflector and the predetermined axis of the lamp base is aligned with the principal axis of the reflector. Since the center of the filament 60 of each lamp bulb has been aligned with the predetermined axis of the lamp base, the center of the filament 60 of each lamp bulb will be automatically aligned with principal axis of the reflector. Similarly, the switch 40 described herein may be employed in a flashlight 20 without employing the lamp and lamp base combination 121. Likewise, the tail cap assembly 28 described herein may also be used in a wide variety of flashlight designs, including those that do not employ a switch 40 or lamp and lamp base combination 121 according to the present invention. It is envisioned that all such alternate embodiments are considered to be within the scope of the present invention as described by the appended claims.

What is claimed is:

1. A tail cap assembly for a flashlight having a barrel, the tail cap assembly comprising:

a cap adapted to engage with the flashlight barrel, the cap including a seat, two ears extending from the seat, and gaps disposed between the two ears; and a conductive spring including a base portion disposed between the ears, at least a part of the base portion arranged to bear against the seat, the base portion configured to extend through at least one of the gaps.

2. A tail cap assembly according to claim 1 wherein each ear is curved.

3. A tail cap assembly according to claim 1 wherein the two ears define an outer diameter, wherein the base portion extends beyond the outer diameter.

4. A tail cap assembly according to claim 1 wherein the conductive spring extends outward in a radial direction through at least one of the gaps.

5. A tail cap assembly according to claim 1 wherein the base portion of the conductive spring is an oval shaped coil, the minor diameter of which is disposed between the two ears and the major diameter of which extends outward in a radial direction through at least one gap.

6. A tail cap assembly according to claim 1 wherein the base portion of the conductive spring extends to engage with the interior of the flashlight barrel when the cap is engaged with the flashlight barrel.

7. A tail cap assembly according to claim 1 wherein each ear has a lip depending from its free end to retain the conductive spring to the cap.

8. A tail cap assembly according to claim 1 wherein the conductive spring is a coil spring.

9. A tail cap assembly according to claim 1 wherein the cap further includes a threaded portion to engage with the flashlight barrel.

10. A tail cap assembly according to claim 1 wherein the base portion of the conductive spring is asymmetrical to facilitate the base portion to extend through at least one gap.

11. A tail cap assembly for a flashlight having a barrel with a forward end and a rearward end, the tail cap assembly comprising:

a tail cap comprising a first body portion having a first end and a second end and being adapted to removably engage the interior of the flashlight barrel at the rearward end, a second body portion attached to the second end of the first body portion and being adapted to enclose the rearward end of the flashlight barrel when the first body portion engages the barrel, and a spring seat at the first end of the first body portion, the spring seat comprising a pair of spaced apart ears, with gaps provided at the ends of the ears; and a conductive spring including a base portion removably retained between the ears of the spring seat, the base portion being adapted to extend outward in a radial direction through the gaps provided between the ears so as to make physical contact with the inner surface of the barrel when the tail cap is engaged with the barrel.

12. A tail cap assembly according to claim 11 further comprising a central cavity open to the first end of the first body portion and positioned between the ears of the spring seat, and a spare bulb holder in the central cavity.

13. A tail cap assembly according to claim 11, wherein the faces of each ear further include a lip adapted to removably retain the spring.

14. A tail cap assembly according the claim 11 further comprising a circumferential channel on the outer periphery of the first body portion adjacent to the second end, and a one-way seal in the circumferential channel.

15. A tail cap assembly according to claim 11, wherein the spring comprises a coil spring, and the base portion comprises an oval shaped coil, the minor diameter of which is removably retained by the spring seat and the major diameter of which extends in a radial direction through the gaps provided between the ears.

16. A tail cap assembly for a flashlight comprising:

a tail cap comprising an externally threaded body portion having a first end and a second end, a cap body portion attached to the second end of the threaded body portion, and a spring seat at the first end of the first body portion, the spring seat comprising a pair a spaced apart ears, with gaps provided at the ends of the ears; and a conductive spring comprising a base portion removably retained between the faces of the ears of the spring seat, the base portion being adapted to extend outward in a radial direction through the gaps provided between the ears.

17. A tail cap assembly according to claim 16 further comprising a central cavity open to the first end of the threaded boy portion and positioned between the ears of the spring seat, and a spare bulb holder in the central cavity.

18. A tail cap assembly according to claim 16, wherein the faces of each ear further include a lip adapted to removably retain the spring.

19. A tail cap assembly according to claim 16 further comprising a circumferential channel on the outer periphery of the threaded body portion adjacent the second end, and a one-way seal in the circumferential channel.

20. A tail cap assembly according to claim 16, wherein the spring comprises a coil spring, and the base portion comprises an oval shaped coil, the minor diameter of which is removably retained by the spring seat and the major diameter of which extends in a radial direction through the gaps provided between the ears.

* * * * *